US010013953B2

(12) United States Patent
Asai et al.

(10) Patent No.: US 10,013,953 B2
(45) Date of Patent: Jul. 3, 2018

(54) DISPLAY CONTROL DEVICE

(71) Applicant: Sharp Kabushiki Kaisha, Osaka-shi, Osaka (JP)

(72) Inventors: Junki Asai, Osaka (JP); Kohji Mitsuda, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/032,062

(22) PCT Filed: Oct. 22, 2014

(86) PCT No.: PCT/JP2014/078026

§ 371 (c)(1),
(2) Date: Apr. 26, 2016

(87) PCT Pub. No.: WO2015/068570

PCT Pub. Date: May 14, 2015

(65) Prior Publication Data

US 2016/0260417 A1 Sep. 8, 2016

(30) Foreign Application Priority Data

Nov. 5, 2013 (JP) ..... 2013-229559

(51) Int. Cl.
*G09G 5/36* (2006.01)
*G09G 5/397* (2006.01)

(52) U.S. Cl.
CPC ..... *G09G 5/363* (2013.01); *G09G 5/397* (2013.01); *G09G 2360/126* (2013.01); *G09G 2360/127* (2013.01); *G09G 2360/128* (2013.01)

(58) Field of Classification Search
CPC ..... G06T 1/20; H04N 19/40
See application file for complete search history.

(56) References Cited

U.S. PATENT DOCUMENTS 5,721,570 A 2/1998 Tsunoda et al.
2003/0043905 A1* 3/2003 Nakayama ..... H04N 1/411 375/240.04

(Continued)

FOREIGN PATENT DOCUMENTS

JP 07-199890 A 8/1995
JP 2000-098993 A 4/2000

(Continued)

OTHER PUBLICATIONS

Official Communication issued in International Patent Application No. PCT/JP2014/078026, dated Jan. 27, 2015.

*Primary Examiner* — Zhengxi Liu
*Assistant Examiner* — Raffi Isanians
(74) *Attorney, Agent, or Firm* — Keating & Bennett, LLP

(57) ABSTRACT

The display controller (1) includes: a DRAM (31); a SRAM (32) which consumes electric power less than the DRAM (31); an update judging section (61); a secondary compression section (70); and a decompression section (40). In a case where the update judging section (61) has judged that image data is not updated, (i) the secondary compression section (70) compresses image data and then stores compressed image data in the SRAM (32), (ii) the DRAM (31) stops a memory retaining operation, and (iii) the decompression section (40) decompresses the compressed image data and then supplies decompressed data to an LCD (3).

5 Claims, 6 Drawing Sheets

(56) References Cited

U.S. PATENT DOCUMENTS

| | | | | |
|---|---|---|---|---|
| 2012/0054441 | A1* | 3/2012 | Nakashima | G06F 11/1441<br>711/124 |
| 2014/0285505 | A1* | 9/2014 | Nakanishi | H04N 19/40<br>345/545 |

FOREIGN PATENT DOCUMENTS

| | | | |
|---|---|---|---|
| JP | 2006-235442 | A | 9/2006 |
| JP | 2013-153257 | A | 8/2013 |

* cited by examiner

DISPLAY CONTROL DEVICE

TECHNICAL FIELD

The present invention relates to a display controller for controlling how an electronic device displays an image.

BACKGROUND ART

An electronic device, such as a personal computer or a smartphone, which includes a display device, generally includes a display controller for carrying out various types of display control in order for an image to be properly displayed on a screen of the display device. The display controller (i) stores, in a frame buffer, image data which has been received from a host and (ii) outputs the image data along with a timing at which the display device displays an image. As a technique for such a display controller, Patent Literature 1, for example, discloses a technique as follows: In a case where it is judged that identical pieces of data continue, data is compressed and stored in a separate region of a frame buffer. In a case where the data is to be outputted, the compressed data is decompressed and outputted. This allows a reduction in the number of accesses made to the frame buffer (i.e. the number of times data is read out), and therefore allows a reduction in electric power consumption of a display controller.

CITATION LIST

Patent Literature

[Patent Literature 1]
Japanese Patent Application Publication, Tokukai, No. 2000-98993 (Publication Date: Apr. 7, 2000)

SUMMARY OF INVENTION

Technical Problem

According to a display controller disclosed in Patent Literature 1, a DRAM (dynamic random access memory) is ordinarily used as a frame buffer. The DRAM is a memory that requires a refreshing operation (memory retaining operation) for retaining stored data (i.e. image data for a display screen). This makes it necessary for the display controller to periodically carry out a refreshing operation in order to retain image data which is stored in the DRAM. The refreshing operation consumes a large amount of electric power, and is therefore a factor that hinders a reduction in electric power consumption of a display controller. The present invention has been made in view of the problem, and it is an object of the present invention to realize a display controller which consumes a reduced amount of electric power.

Solution to Problem

In order to attain the object, a display controller according to an aspect of the present invention includes: a first memory in which image data received from a host is to be stored; a second memory which consumes electric power less than the first memory; an update judging section for judging whether or not the image data received from the host is updated; a compression section; and a decompression section, the display controller supplying the image data to a display section at a predetermined timing, and in a case where the update judging section has judged that the image data received from the host has not been updated, the compression section (i) subjecting the image data read out from the first memory to secondary compression, so that secondary compressed data is generated and then (ii) storing the secondary compressed data in the second memory, the first memory stopping an memory retaining operation, and the decompression section (i) decompressing the secondary compressed data read out from the second memory, so that secondary decompressed data is generated and then (ii) supplying the secondary decompressed data to the display section.

Advantageous Effects of Invention

An aspect of the present invention brings about such an effect as reducing electric power consumption of a display controller.

DESCRIPTION OF EMBODIMENTS

Embodiment 1

The following description will discuss Embodiment 1 of the present invention. A configuration of a display controller 1 according to Embodiment 1 will be described first with reference to FIG. 2.

<<Main Configuration>>

Figure 2:
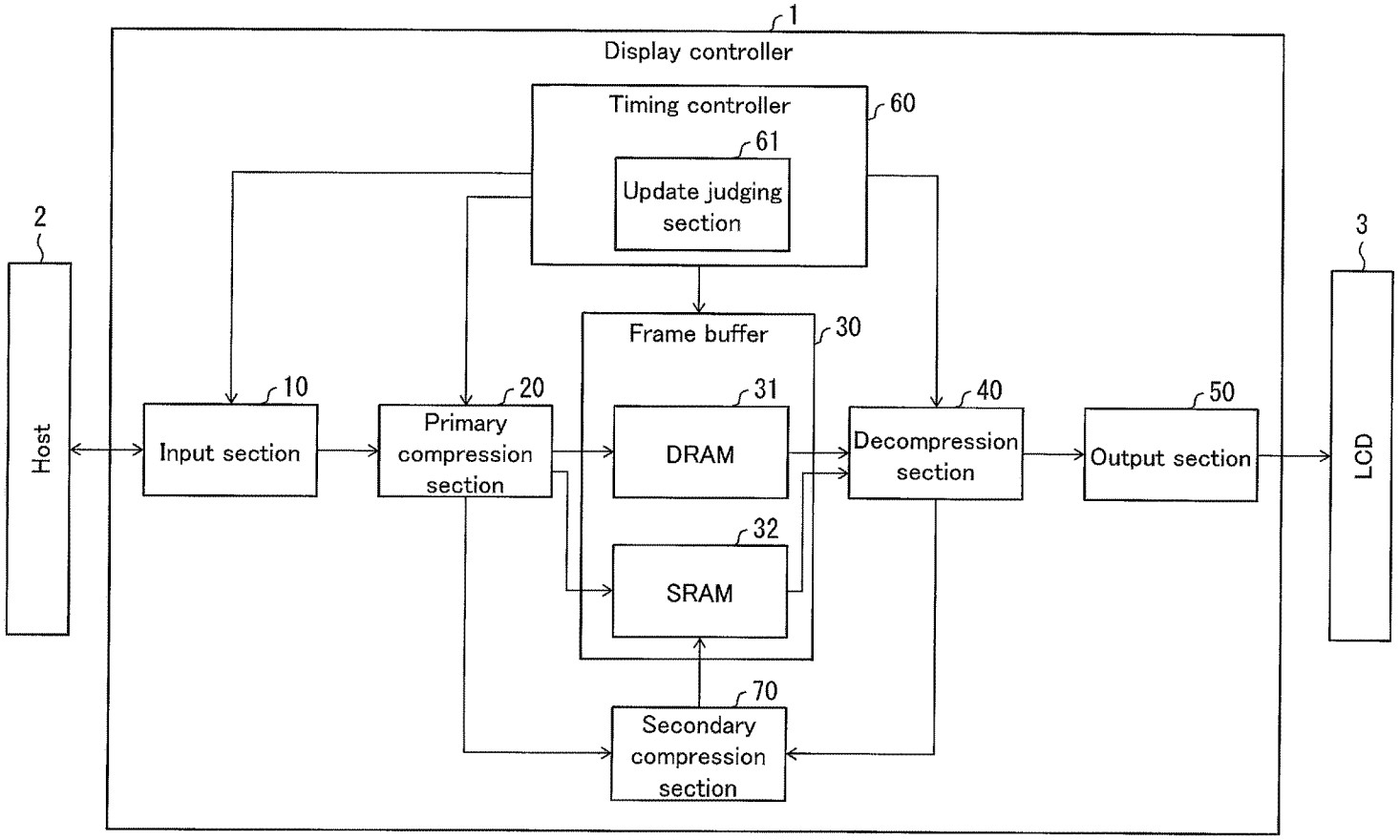
FIG. 2 is a block diagram illustrating a main configuration of the display controller.
Figure 3:
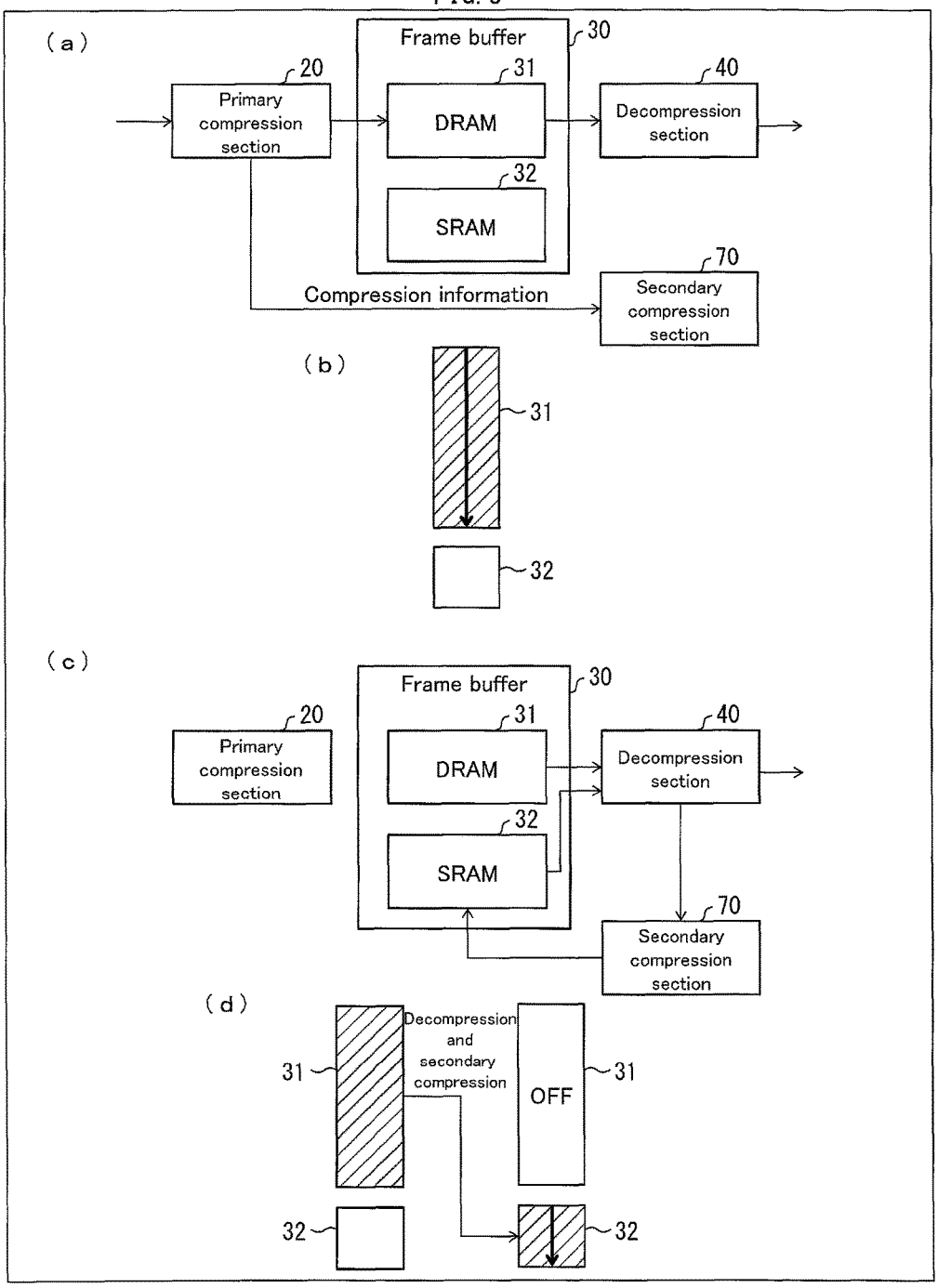
FIG. 3 illustrates (i) a flow of input/output of image data into/from the display controller and (ii) how data is written into a DRAM and a SRAM.

FIG. 2 is a block diagram illustrating a main configuration of the display controller 1. FIG. 3 also illustrates a host 2 and an LCD 3. Note that the following description will discuss the display controller 1, the host 2 and the LCD 3 as separate devices. According to the present invention, however, the display controller 1, the host 2, and the LCD 3 (display section) can be alternatively configured as a single electronic device. For example, the present invention can be a smartphone, a tablet PC or the like which includes a display controller 1, a host 2, and an LCD 3.

The host 2 generates pieces of image data to be displayed by the LCD 3, and sequentially provides the pieces of image data to the display controller 1. Note that "image data" herein refers to an image of a single frame, which image is to be displayed by the LCD 3. The host 2 transmits image data to the display controller 1 in synchronization with a TE (Tearing Effect) signal supplied from the display controller 1. Assume a case where target image data to be displayed by the LCD 3 during an immediately following frame is identical to image data which has been transmitted to the display controller 1 during a preceding frame (i.e. there is no change on a display screen of the LCD 3). In such a case, it is possible that the host 2 does not transmit any image data to the display controller 1 or transmits image data identical to the image data which has been transmitted in the preceding frame.

The LCD 3 is a liquid crystal display (LCD) for displaying image data which has been received from the display controller 1. Note that a configuration of the LCD 3 is not particularly limited, provided that the LCD 3 can display the image data. Therefore, the LCD 3 can be a display device other than a liquid crystal display. Examples of the LCD 3 encompass (i) a display employing a cathode ray tube (CRT), (ii) a plasma display, (iii) an organic EL (electroluminescence) display, and (iv) a field emission display.

The display controller 1 receives and stores image data from the host 2. Then, the display controller 1 supplies the image data to the LCD 3 at predetermined timings along with timings of the LCD 3. The display controller 1 transmits a TE signal which carries a notification of a timing at which the host 2 is to input (transmit) image data to the display controller 1. Then, the display controller 1 receives image data transmitted from the host 2 in synchronization with the TE signal, and then stores the image data. A timing, at which the host 2 inputs (transmits) image data to the display controller 1, will be hereinafter referred to as "input start timing". The display controller 1 starts supplying the image data, which has been received from the host 2, to the LCD 3 at a timing at which the LCD 3 refreshes a screen. A timing, at which the display controller 1 supplies (transmits) image data to the LCD 3, will be hereinafter referred to as "output start timing". An output start timing is preferably decided in view of (i) a speed at which the host 2 supplies image data to the display controller 1 and (ii) a speed at which the display controller 1 supplies image data to the LCD 3. This prevents the LCD 3 from encountering tearing. Note that a length of period from a given output start timing to an immediately following output start timing corresponds to a single vertical period of the LCD 3.

In Embodiment 1, input start timings (at which TE signals are transmitted) are assumed to set at regular intervals, and output start timings are assumed to follow corresponding input start timings by a predetermined amount of time. However, neither input start timings nor output start timings need to set be at regular intervals.

To describe the display controller 1 in more detail, the display controller 1 includes an input section 10, a primary compression section 20 (compression information generating section, storage section), a frame buffer 30, a decompression section 40, an output section 50, a timing controller 60, and a secondary compression section 70 (compression section).

The input section 10 is an interface for connecting the host 2 and the display controller 1. The input section 10 transmits, to the host 2, TE signals supplied from the timing controller 60 (described later). In a case where the input section 10 receives image data from the host 2, the input section 10 sequentially transmits the image data to the primary compression section 20. The output section 50 is an interface for connecting the display controller 1 and the LCD 3. The output section 50 transmits, to the LCD 3, image data supplied from the decompression section 40 (described later).

The primary compression section 20 compresses image data received from the input section 10, and then writes compressed image data into a DRAM 31 of the frame buffer 30. In a case where the primary compression section 20 has received image data from the input section 10, the primary compression section 20 subjects the image data to a predetermined data compression process. A predetermined data compression process, which is carried out by the primary compression section 20, will be hereinafter referred to as "primary compression". Image data, which has been subjected to primary compression, will be hereinafter referred to as "primary compressed data".

In a case where compression of image data of a single frame has been completed during the primary compression, the primary compression section 20 further generates compression information which indicates a characteristic of the image data. The primary compressed data thus generated is then written into the DRAM 31. The compression information is transmitted to the secondary compression section 70. Primary compression and compression information will be described later in detail.

The secondary compression section 70 compresses image data with the use of a compression ratio which is lower than that used in primary compression. Then, the secondary compression section 70 writes the compressed image data into the SRAM 32. Note that "compression ratio" herein refers to a percentage (%) of a data size of compressed data with respect to a data size of image data which is to be compressed. That is, the following equation is true: Compression ratio (%)=(size of compressed image data/size of image data to be compressed×100). It can therefore be said that a lower compression ratio means higher density with which image information is compressed (i.e. smaller data size after compression). In a case where the secondary compression section 70 receives compression information from the primary compression section 20 and receives image data from the decompression section 40 described later, the secondary compression section 70 subjects, based on the compression information, the image data to a predetermined data compression process with the use of a compression ratio lower than that used in the primary compression. A predetermined data compression process, which is carried out by the secondary compression section 70, will be hereinafter referred to as "secondary compression". Image data, which has been subjected to secondary compression, will be hereinafter referred to as "secondary compressed data". The secondary compressed data thus generated is then written into the SRAM 32.

<<Primary Compression and Secondary Compression>>

Primary compression, secondary compression, and compression information will be described below in detail. Primary compression is carried out to convert a size of image data received from the host 2, so that compressed image data can be written into the DRAM 31. The primary compression section 20 can, for example, subject image data to primary compression by use of a predetermined method and predetermined parameters. Examples of a specific method for carrying out the primary compression encompass, but are not particularly limited to, (i) a method in which compression is carried out by subjecting image data to run-length coding, (ii) a method in which compression is carried out by quantizing differences in parameters of adjacent pixels (i.e. ADPCM (adaptive differential pulse-code modulation) encoding), and (iii) a method in which compression is carried out by changing a quantization level of image data. Note that primary compression can be lossless compression or lossy compression.

Compression information indicates a characteristic of image data which has been obtained by various processes involved in primary compression. Possible examples of compression information encompass, but are not particularly limited to, (i) statistical information about a data value of image data (such as a histogram indicative of frequencies of pixel values), (ii) information indicative of predicted values of a compression ratio (such as predicted values of compression ratio which, in a case where the quantization level is changed, correspond to respective quantization levels) in a case where compression is carried out by use of predetermined parameters (such as (a) quantization level and (b) an initial value of a random number) and by use of a predetermined compression method, and (iii) information indicative of a degradation level of an image (such as a degradation level of an image in a case where a random number sequence has been changed). Note that a predicted value of a compression ratio and a degradation level of an image are, for example, monitored while part of or an entire portion of image data is being compressed by the primary compression section 20.

Meanwhile, secondary compression is carried out, in accordance with compression information which has been generated by the primary compression section 20, to compress image data by changing a compression method and parameters. Note that secondary compression can also be lossless compression or lossy compression. Note also that primary compression and secondary compression can be carried out by use of an identical compression method. However, secondary compression is preferably carried out to generate, by use of compression information, secondary compressed data which has a lower compression ratio or high quality (i.e. having a small degradation level).

For example, assume the case where the secondary compression section 70 receives, as compression information, a histogram indicative of frequencies of pixel values. In this case, since the histogram shows appearance probability of pixel values, variable-length coding (such as Huffman coding or arithmetic coding) as secondary compression can be efficiently carried out (with a low compression ratio). Assume the case where, for example, the secondary compression section 70 receives, as compression information, coefficients (parameters) for use in calculations of various compressions. In this case, it is possible to carry out various compressions such as ADPCM encoding with the use of proper parameters. Assume the case where the secondary compression section 70 receives, as compression information, a predicted value of a compression ratio. In this case, it is possible to carry out compression by quantization with the use of an optimum quantization level (compression level). Assume the case where, for example, the secondary compression section 70 receives, as compression information, (i) a degradation level of an image in a case where a random number sequence has been changed and/or (ii) an initial value of a random number. In this case, encoding as secondary compression can be carried out by rearranging data (i) in view of the degradation level and/or (ii) by use of an optimum initial value of the random number.

During secondary compression, it is thus possible to carry out optimum compression by use of compression information which has been generated during primary compression. Specifically, by use of a characteristic of image data (compression information) supplied from the host 2, it is possible to carry out compression with a lower compression ratio or to generate secondary compressed data having higher quality. Alternatively, the secondary compression section 70 can (i) store a plurality of compression methods (compression algorithms) as a method for secondary compression or store a plurality of compression parameters (coefficients and random number initial values) and then (ii) select an optimum compression method or an optimum parameter according to compression information which corresponds to image data. Alternatively, it is possible to pre-assign a priority rank to each of the compression methods and the parameters.

The decompression section 40 decompresses primary compressed data or secondary compressed data. In response to an instruction from the timing controller 60 (described later), the decompression section 40 reads out primary compressed data from the DRAM 31, and then decompresses the primary compressed data. The primary compressed data which has been thus decompressed (i.e. image data) is then transmitted to the output section 50 or to the secondary compression section 70 in accordance with an instruction from the timing controller 60. In response to an instruction from the timing controller 60, the decompression section 40 further reads out secondary compressed data from the SRAM 32, and then decompresses the secondary compressed data. The secondary compressed data which has been thus decompressed (i.e. image data) is then transmitted to the output section 50.

The frame buffer 30 is a memory for storing image data. The frame buffer 30 includes the DRAM 31 (first memory) and the SRAM 32 (second memory). The DRAM 31 is a memory for storing primary compressed data, and requires a refreshing operation (memory retaining operation) for retaining information stored therein. In the following description, (i) to "run the DRAM 31" means to control the DRAM 31 to start refreshing operations and (ii) to "stop the DRAM 31" means to control the DRAM 31 to continuously stop refreshing operations. According to the present invention, however, (i) to "run the DRAM 31" can mean to run a power source circuit which is necessary for an operation of the DRAM 31 and (ii) to "stop the DRAM 31" can mean to stop the power source circuit. In the following description, unless specifically stated otherwise, to "run (or stop) the DRAM 31" means to run (or stop) all of storage regions (regions into/from which primary compressed data is to be written/read) of the DRAM 31.

Meanwhile, the SRAM 32 is a memory for storing secondary compressed data. The SRAM 32 does not require a refreshing operation for retaining stored information, and consumes electric power less than the DRAM 31. Note that the SRAM 32 can be smaller in capacity than the DRAM 31. In Embodiment 1, the frame buffer 30 includes a DRAM and a SRAM. However, memories included in the frame buffer 30 are not limited to a DRAM and a SRAM. That is, the frame buffer 30 according to the present invention can include any type of first memory and any type of second memory, provided that (i) the first memory is capable of storing primary compressed data and (ii) the second memory is capable of storing secondary compressed data and consumes electric power less than the first memory.

The timing controller 60 carries out timing control for controlling timings of input/out into/from the display controller 1. A function of the timing controller 60 will be described later in detail. To describe the timing controller 60 in more detail, the timing controller 60 includes an update judging section 61.

The update judging section 61 judges whether or not image data supplied from the host 2 is updated. The update judging section 61 judges whether or not image data, which the display controller 1 is to start supplying to the LCD 3, has been received (or is being received) from the host 2. In a case where the image data to be supplied to the LCD 3 has been received, the update judging section 61 judges that image data supplied from the host 2 is updated. On the other hand, in a case where the image data has not been received from the host 2, the update judging section 61 judges that image data to be supplied to the LCD 3 has not been updated. Note that although a judgment is made at an output start timing in Embodiment 1, a timing of the judgment is not particularly limited, provided that the judgment is made between an input start timing and an output start timing.

Note that the update judging section 61 can judge that image data supplied from the host 2 has not been updated also in a case where image data received from the host 2 during current transmission from the host 2 is identical to image data which was received during immediately preceding transmission from the host 2 (i.e. in a case where there is no change in image data to be displayed by the LCD 3). Furthermore, assume a case where (i) the update judging section 61 judges that image data has not been updated as a result of judging that image to be supplied to the LCD 3 has not been received and then (ii) the input section 10 receives, from the host 2, image data of subsequent frames. In this case, the update judging section 61 detects reception of the image data from the host 2 so as to judge that updating of image data from the host 2 has been restarted.

<<Flow of Image Data>>

A flow of input/output of image data into/from the display controller 1 will be described next with reference to FIG. 3. (a) of FIG. 3 illustrates a flow of input/output of image data in a case where image data from the host 2 is updated. (b) of FIG. 3 illustrates storage regions of respective of the DRAM 31 and the SRAM 32 as illustrated in (a) of FIG. 3. In contrast, (c) of FIG. 3 illustrates a flow of input/output of image data at a time point at which updating on image data from the host 2 has stopped (at a time point at which a change has occurred from "image data is updated" to "image data has not been updated"). (d) of FIG. 3 illustrates storage regions of the DRAM 31 and of the SRAM 32 as illustrated in (c) of FIG. 3. In each of (b) and (d) of FIG. 3, each block of the DRAM 31 and the SRAM 32 represent an entire storage region included in the DRAM 31 and the SRAM 32. In each of (b) and (d) of FIG. 3, shaded portions indicate that pieces of data are being written into the storage regions corresponding to the shaded portions. In each of (b) and (d) of FIG. 3, bold arrows indicate that a corresponding piece of data is being written.

In a case where image data from the host 2 is updated as illustrated in (a) of FIG. 3, the display controller 1 receives, from the host 2, image data which is to be displayed by the LCD 3. In this case, the image data received from the host 2 is subjected to primary compression by the primary compression section 20 at an input start timing, and is written into the DRAM 31. Then, primary compressed data thus made is then (i) read out by the decompression section 40 at an output start timing, (ii), decompressed, and then (iii) supplied to the output section 50. In a case where image data is updated, primary compressed data is thus written into the DRAM 31 and is then read out from the DRAM 31 as illustrated in (b) of FIG. 3.

On the other hand, in a case where updating of image data from the host 2 has stopped as illustrated in (c) of FIG. 3, image data to be displayed by the LCD 3 during an immediately following frame is not supplied from the host 2 to the display controller 1 even at an output start timing. In this case, the primary compressed data written into the DRAM 31 is read out by the decompression section 40, and is then decompressed. Then, the primary compressed data thus decompressed is then subjected to secondary compression by the secondary compression section 70. In a case where updating of image data stops, primary compressed data is thus read out from the DRAM 31, decompressed, subjected to secondary compression, and written into the SRAM 32 as illustrated in (d) of FIG. 3. Note that in a case where primary compressed data has been read out or where writing of secondary compressed data into the SRAM 32 has been completed, the DRAM 31 stops. Thereafter, until updating of image data is restarted, the display controller 1 keeps the DRAM 31 stopped, and, along with a timing at which the LCD 3 refreshes the screen, (i) reads out secondary compressed data from the SRAM 32, (ii) decompresses the secondary compressed data, and (iii) outputs decompressed data.

Depending on whether or not image data from the host 2 is updated, the display controller 1 thus changes (i) which of the DRAM 31 and the SRAM 32 to write image data into and (ii) which of the DRAM 31 and the SRAM 32 to read out image data from. It is the timing controller 60 that carries out such control to (i) judge whether or not image data from the host 2 is updated and (ii) decides which memories to write/read out image data into/from. The function of the timing controller 60 will be described next in detail.

<<Control of Process of Timing Controller>>

Figure 4:
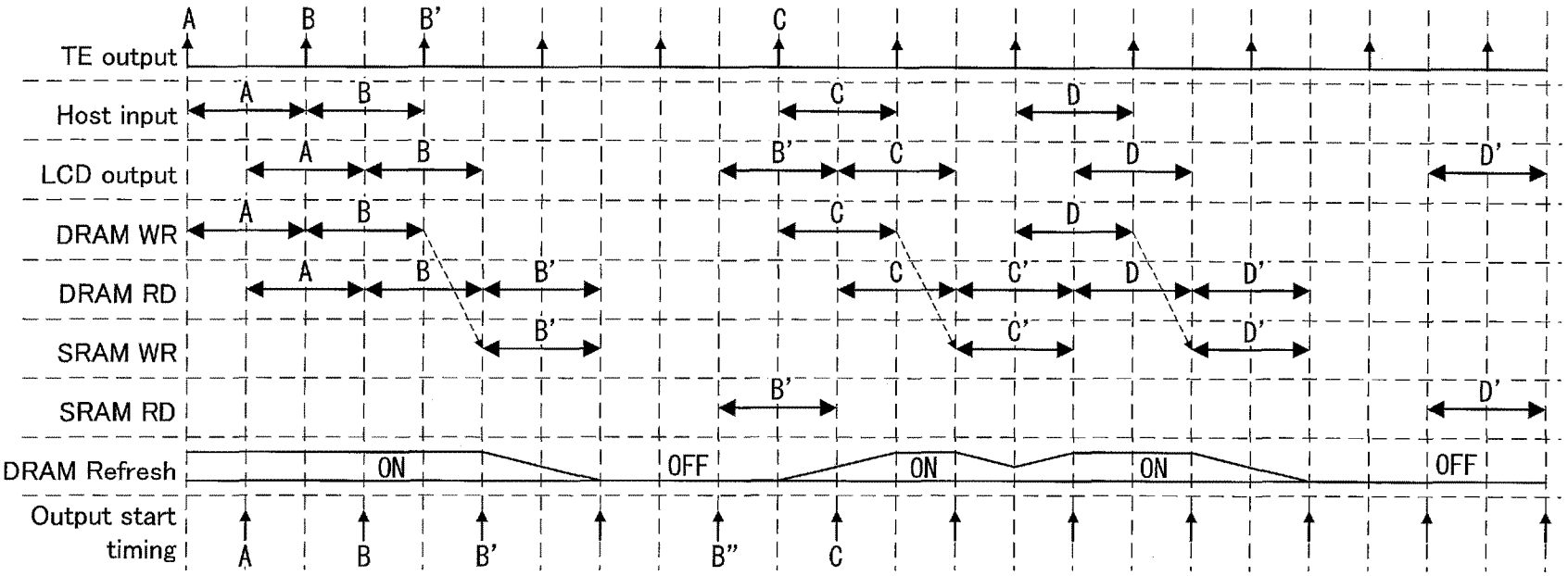
FIG. 4 is a timing chart illustrating a process carried out by the display controller.

Timing control carried out by the timing controller 60 to control timings of input/output will be described below in detail with reference to FIG. 4. FIG. 4 is a timing chart illustrating a process carried out by the display controller 1 in a case where image data A through image data D have been sequentially supplied from the host 2. Note that in the example of FIG. 4, (i) the image data A and the image data B are consecutively transmitted, (ii) updating of the screen is suspended, and then (iii) image data C and image data D are transmitted.

A "TE output" row in FIG. 4 indicates, by upward arrows, timings at which the timing controller 60 supplies TE signals to the host 2, namely, input start timings. An "output start timing" row in FIG. 4 indicates output start timing by upward arrows. Note that intervals between the output start timings each correspond to a single vertical period of the LCD 3.

A "host input" row indicates each process in which the host 2 supplies image data to the display controller 1. An "LCD output" row indicates each process in which the display controller 1 supplies image data to the LCD 3. A "DRAM WR" row indicates writing (WR) of image data (primary compressed data) into the DRAM. A "DRAM RD" row indicates reading (RD) of image data (primary compressed data) from the DRAM. A "SRAM WR" row indicates writing (WR) of image data (secondary compressed data) into the SRAM. A "SRAM RD" row indicates reading (RD) of image data (secondary compressed data) from the SRAM. Note that solid arrows A through D shown on the "host input" row through the "SRAM RD" row each indicate a period between a starting point and a completion point of processing of a corresponding one of the image data A through the image data D on the corresponding row. For example, the solid arrow A on the "DRAM WR" row indicates a period between (i) a time point at which writing of the image data A into the DRAM 31 is started and (ii) a time point at which the writing is completed.

A "DRAM Refresh" row indicates, by a polygonal line, running (turning on) and stopping (turning off) of a power supply (for the refreshing operations) of the DRAM 31. In the example shown in FIG. 4, the DRAM 31 is partitioned into a plurality of banks such that refreshing operations in the respective banks can be controlled (i.e. turned on and off) independently of each other. In a case where image data needs to be written into banks whose respective refreshing operations are turned off in such a DRAM 31, the refreshing operations are sequentially turned on. Peaks of mountainlike portions of the polygonal line shown in FIG. 4 indicate time points at which the refreshing operations of all the banks are turned on. Periods indicated by ascending portions and descending portions of the polygonal line are periods during which refreshing operations of part of the banks of the DRAM 31 are turned on. Meanwhile, in a case where secondary compression has been started and therefore no image data is being supplied from the host 2, refreshing operations of banks which have become unnecessary in the DRAM 31 are then sequentially turned off. Valley-like portions of the polygonal line (indicated by "OFF" in FIG. 4) represent periods during which the refreshing operations of all the banks are turned off.

At an input start timing, the timing controller 60 transmits a TE signal to the host 2 (as indicated by the arrow A on the "TE output" row). Then, in synchronization with the TE signal, the host 2 starts transmitting image data (image data A) to the primary compression section 20 via the input section 10 (as indicated by the arrow A on the "host input" row). The primary compression section 20 receives the image data A in portions, and, in the order in which the portions are received, sequentially subjects the portions of the image data A to primary compression and then sequentially writes the compressed portions into the DRAM 31 (as indicated by the arrow A on the "DRAM WR" row).

At an output start timing (as indicated by the arrow A on the "output start timing" row) which is a predetermined amount of time after the input start timing, the timing controller 60 gives an instruction to the decompression section 40 that the primary compressed data be outputted. In response to the instruction, the decompression section 40 starts reading out the primary compressed data (image data A) from the DRAM 31 (as indicated by the arrow A on the "DRAM RD" row). The primary compressed data thus read out is decompressed, and then supplied to the LCD 3. Note that as illustrated in FIG. 4, writing of the image data into the DRAM 31 by the primary compression section 20 and reading out of the image data from the DRAM 31 by the decompression section 40 can be simultaneously carried out (as indicated by the arrows A on respective of the "DRAM WR" row and the "DRAM RD" row). At a next input start timing (as indicated by the arrow B on the "TE output" row) and at a next output start timing (as indicated by the arrow B on the "output start timing" row), the timing controller 60 likewise carries out timing control, so that the image data B is processed as is the case of the image data A.

Meanwhile, at a next input start timing (as indicated by the arrow B' on the "TE output" row), the timing controller 60 transmits a TE signal to the host 2, but the host 2 does not transmit image data. This causes no image data to be subjected to primary compression and causes no image data to be written into the DRAM 31. In this case, at a next output start timing (as indicated by the arrow B' on the "output start timing" row), the update judging section 61 of the timing controller 60 judges that image data has not been updated. Furthermore, the timing controller 60 judges whether or not the DRAM 31 is running.

As illustrated in FIG. 4, at the output start timing (B'), (i) the DRAM 31 is running (turned on) and (ii) no image data is supplied from the host 2. This causes the timing controller 60 to give an instruction to the decompression section 40 that image data be transmitted to the secondary compression section 70. In response to the instruction, the decompression section 40 reads out the primary compressed data (image data B) from the DRAM 31 (as indicated by the arrow B' on the "DRAM RD" row), decompresses the primary compressed data, and then transmits the decompressed primary compressed data to the secondary compression section 70. In a case where the secondary compression section 70 has received the primary compressed data (image data B) thus decompressed, the secondary compression section 70 carries out secondary compression by use of (i) the primary compressed data and (ii) compression information generated by the primary compression section 20 during the primary compression of the image data B. Secondary compressed data generated is then written into the SRAM 32 (as indicated by the arrow B on the "SRAM WR" row). In other words, the image data B written into the DRAM 31 during the period indicated by the arrow B on the "DRAM WR" row is subjected to secondary compression, so that the image data B is stored as a backup in the SRAM 32 during the period indicated by the arrow B' on the "SRAM WR" row.

Thereafter, even while image data from the host 2 has not been updated, the timing controller 60 (i) transmits a TE signal at an input start timing and (ii) judges whether or not image data is updated at an output start timing (see FIG. 4). Even while image data from the host 2 has not been updated, the timing controller 60 controls the decompression section 40 to supply image data to the LCD 3 at predetermined intervals (as indicated by the arrow B' on the "LCD output" row). During this period, image data has not been updated, and the DRAM 31 is stopped (turned off). This causes the timing controller 60 to give an instruction to the decompression section 40 that the secondary compressed data stored in the SRAM 32 be outputted. In response, the decompression section 40 to decompresses the secondary compressed data (as indicated by the arrow B on the "SRAM RD" row), and then outputs the decompressed secondary compressed data. In the example of FIG. 4, even while image data has not been updated, the display controller 1 still transmits secondary compressed data at every three vertical periods so as to correspond to refreshing of the LCD.

In a case where, at an input start timing (as indicated by the arrow C on the "TE output" row), the host 2 restarts transmitting image data (image data C) to the display controller 1 (as indicated by the arrow C on the "host input" row), the update judging section 61 of the timing controller 60 detects the restart of transmission of image data so that the timing controller 60 sequentially runs the storage regions of the DRAM 31. Then, the primary compression section 20 sequentially writes the primary compressed data into the running storage regions (as indicated by the arrow C on the "DRAM WR" row). The timing controller 60 of the display controller 1 thus (i) carries out timing control for controlling timings of input/output and (ii) makes various judgments concerning the display controller 1 all together.

<<Flow of Process at Output Start Timing>>

Figure 1:
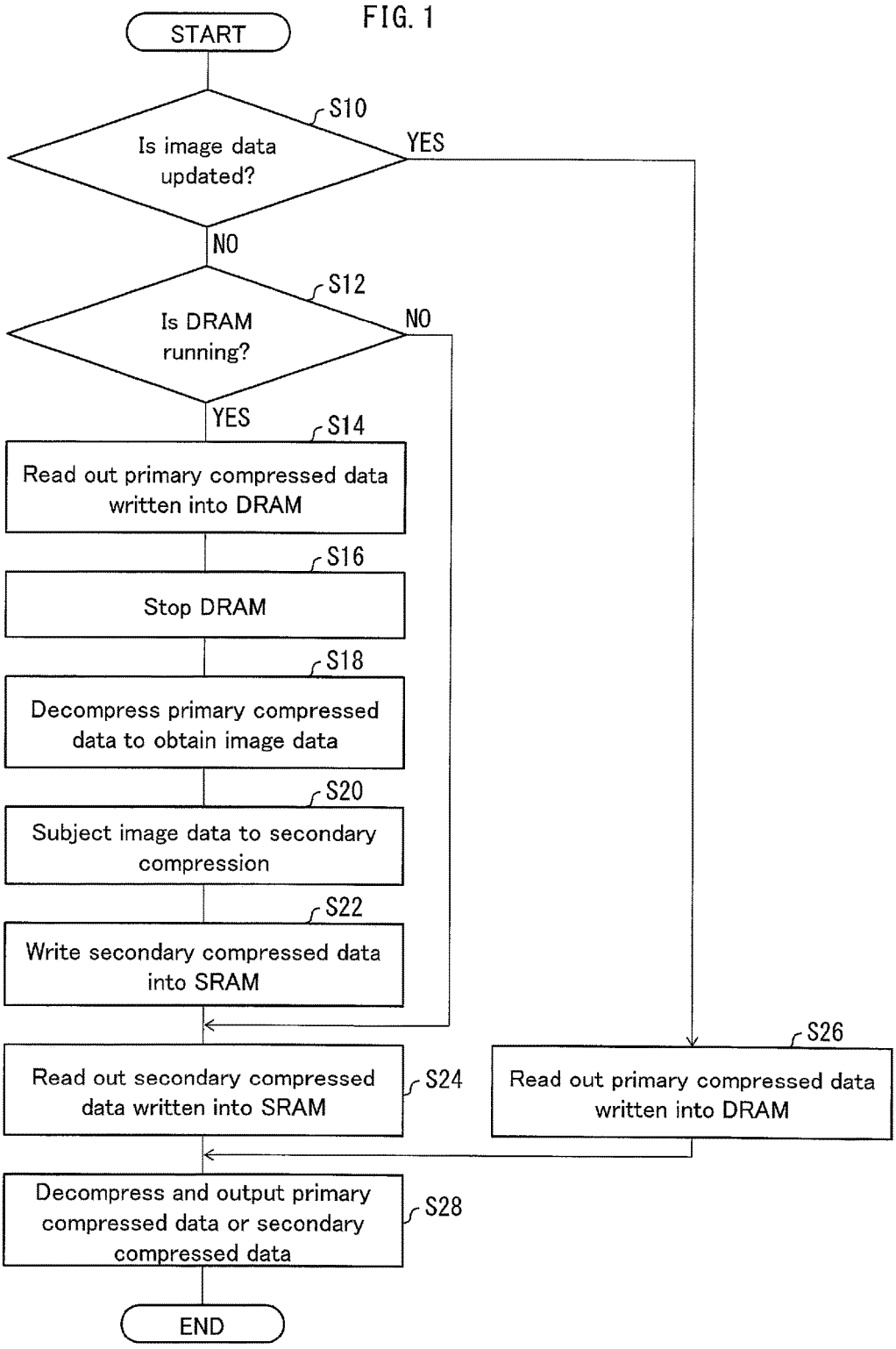
FIG. 1 is a flow chart illustrating a flow of a process carried out by a display controller according to Embodiment 1 of the present invention.

A flow of a process carried out by the display controller 1 at an output start timing will be described next with reference to FIG. 1. FIG. 1 is a flow chart illustrating the flow of the process carried out by the display controller 1 at an output start timing. At an output start timing, the update judging section 61 of the timing controller 60 judges whether or not image data supplied from the host 2 is updated (S10). In a case where the update judging section 61 has judged that image data is updated (YES in S10), the timing controller 60 gives an instruction to the decompression section 40 that primary compressed data be outputted. Then, the decompression section 40 reads out primary compressed data which is stored in the DRAM 31 (S26), decompresses the primary compressed data, and then supplies the decompressed primary compressed data to the LCD 3 (S28). On the other hand, in a case where the update judging section 61 has judged that image data has not been updated (NO in S10), the timing controller 60 then judges whether or not the DRAM 31 is running (S12).

In a case where the DRAM is running (YES in S12), the timing controller 60 gives an instruction to the decompression section 40 that image data be transmitted to the secondary compression section 70. Then, the decompression section 40 reads out primary compressed data stored in the DRAM 31 (S14). In so doing, the timing controller 60 sequentially stops parts of the DRAM 31 such that parts from which the primary compressed data has been read out are stopped first (S16). Furthermore, the decompression section 40 decompresses the primary compressed data thus read out (S18), and then transmits the primary compressed data to the secondary compression section 70. Then, the secondary compression section 70 carries out secondary compression by use of (i) the primary compressed data (image data) thus decompressed and (ii) compression information which has been received from the primary compression section 20 at an input start timing and which corresponds to the primary compressed data (S20). Then, the secondary compression section 70 stores secondary compressed data generated in the SRAM 32 (S22). Thereafter, until updating of image data is restarted, the timing controller 60 gives an instruction to the decompression section 40 that secondary compressed data be outputted at predetermined intervals. Then, the decompression section 40 reads out secondary compressed data written into the SRAM 32 (S24), decompresses the secondary compressed data, and then outputs the decompressed secondary compressed data (S28).

On the other hand, in a case where the timing controller 60 has judged that the DRAM is not running (NO in S12), the timing controller 60 does not carry out the steps S14 through S22, but the decompression section 40 reads out secondary compressed data stored in the SRAM 32 (S24), decompresses the secondary compressed data, and then outputs the decompressed secondary compressed data (S28).

In the above steps, the DRAM 31 need only be stopped between (i) a time point at which data is read out from the DRAM 31 and (ii) a next input start timing. That is, it is not limited to any particular order whether the step of stopping the DRAM 31 is carried out before or after any of the other steps. Specifically, the step S16 in FIG. 1 need only be carried out anywhere between step S14 and step S24. Note that in the above steps, the secondary compressed data is supplied to the LCD 3 (i) after the secondary compressed data has been written into the SRAM 32 and (ii) at predetermined intervals. Alternatively, the display controller 1 can write secondary compressed data into the SRAM 32 and then continue on to decompress the secondary compressed data and supply the secondary compressed data to the LCD 3. Specifically, the display controller 1 can carry out the steps up to the step S22 in FIG. 1, and then continue on to carry out the steps S24 and S28. Alternatively, the display controller 1 can carry out the step S18 in FIG. 1 and then (i) supply decompressed primary compressed data to the LCD 3 as well as (ii) transmit the decompressed primary compressed data to the secondary compression section 70 so that secondary compression will be carried out.

Embodiment 2

The following description will discuss Embodiment 2 of the present invention. For convenience, members similar in function to those described in Embodiment 1 will be given the same reference signs, and their description will be omitted. This is also true of Embodiment 3. In a case where transmission of image data from a host 2 is restarted at an input start timing, a display controller 1 according to an aspect of the present invention can temporarily write received image data into a SRAM 32 until a DRAM 31 becomes available. In such a case, depending on whether or not the DRAM 31 is available, a primary compression section 20 changes a destination into which primary compressed data is to be written.

Note that the DRAM 31 "becoming available" herein means that the DRAM 31 becomes able to store at least part of primary compressed data. For example, the DRAM 31 can be judged "available" in a case where a total capacity of running storage regions of the DRAM 31 becomes larger than a data size of primary compressed data to be written at once into the DRAM 31. Note that such judgment can be made by the timing controller 60 or by the primary compression section 20. A flow of input/output of image data into/from the display controller 1 according to Embodiment 2 will be described below with reference to FIG. 5. Note that arrows, blocks, and the like shown in (a) through (d) of FIG. 5 have meanings similar to the meanings of those shown in FIG. 3.

<<Flow of Image Data>>

Figure 5:
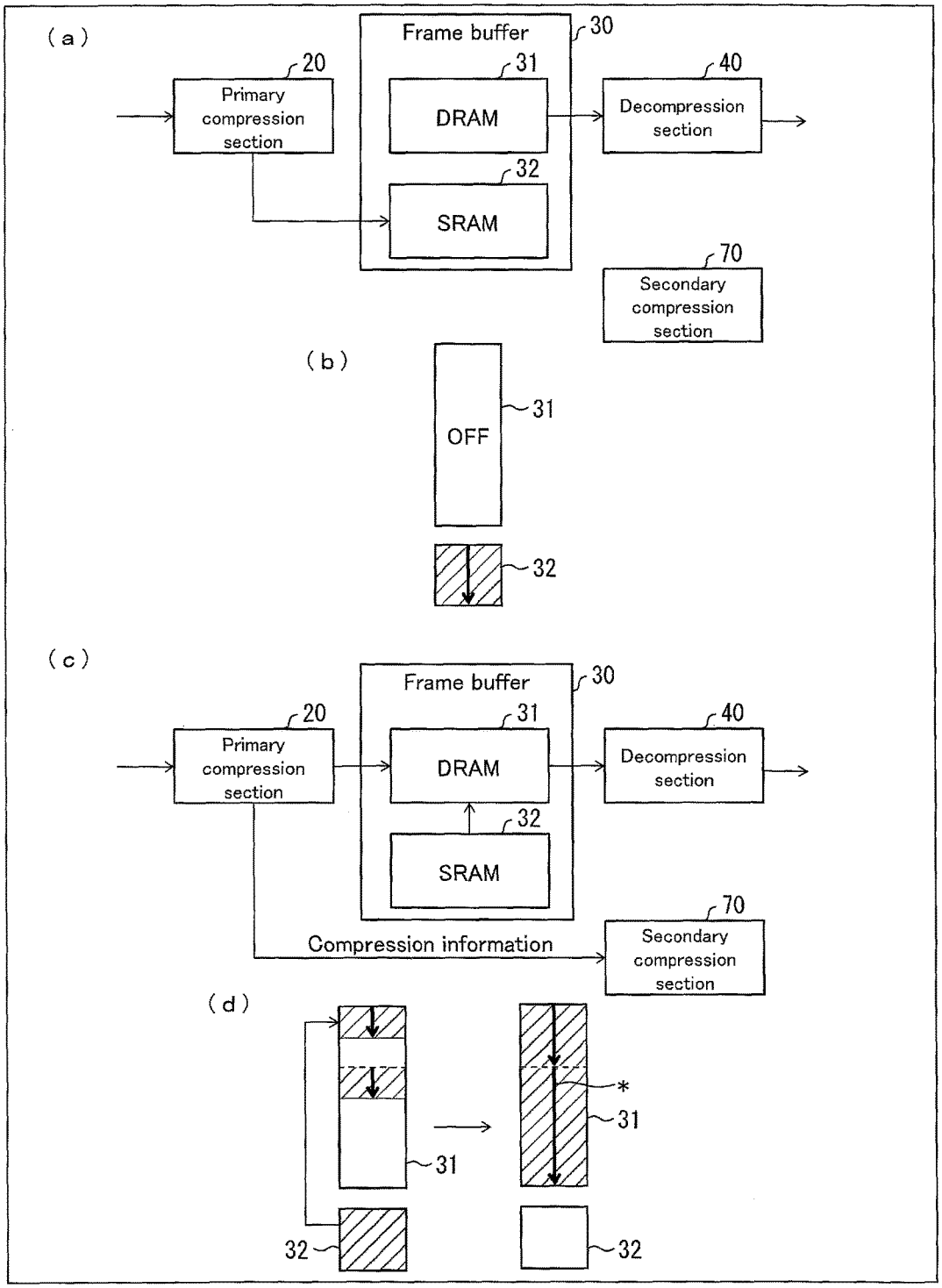
FIG. 5 is a flow chart illustrating a flow of a process carried out by a display controller according to Embodiment 2 of the present invention.

(a) and (c) of FIG. 5 illustrate a flow of input/output of image data during a first frame after (i) transmission of image data from the host 2 is suspended and then (ii) reception of image data transmitted from the host 2 is restarted. (b) of FIG. 5 illustrates storage regions of respective of the DRAM 31 and the SRAM 32 illustrated in (a) of FIG. 5. (d) of FIG. 5 illustrates storage regions of respective of the DRAM 31 and the SRAM 32 illustrated in (c) of FIG. 5. In a case where transmission of image data from the host 2 is restarted, the timing controller 60 detects the restart of the transmission, so that the timing controller 60 sequentially runs the storage regions of the DRAM 31. As illustrated in (a) of FIG. 5, image data is transmitted to the primary compression section 20 via an input section 10. Parts of the image data are then sequentially subjected to primary compression, and sequentially written into the SRAM 32 until the DRAM 31 becomes available (see (b) of FIG. 5). In a case where the DRAM 31 has become available, (i) remaining parts of the primary compressed data are written into the DRAM 31 by the primary compression section 20 and (ii) the parts of the primary compressed data, which parts were written into the SRAM 32, are also written into the DRAM 31 (see (c) of FIG. 5)).

Note that in a case where the primary compression section 20 writes primary compressed data into the DRAM 31, it is preferable that an amount of storage region(s) corresponding to a size of part the primary compressed data written into the SRAM 32 is kept available in the DRAM 31, and then, as indicated by an arrow* in (d) of FIG. 5, a remaining part of the primary compressed data first starts to be written into a remaining part of the DRAM 31. This allows data to be written into the DRAM 31 simultaneously from the primary compression section 20 and the SRAM 32, and therefore allows for a reduction in the amount of time required to write primary compressed data.

<<Flow of Process at Input Start Timing>>

Figure 6:
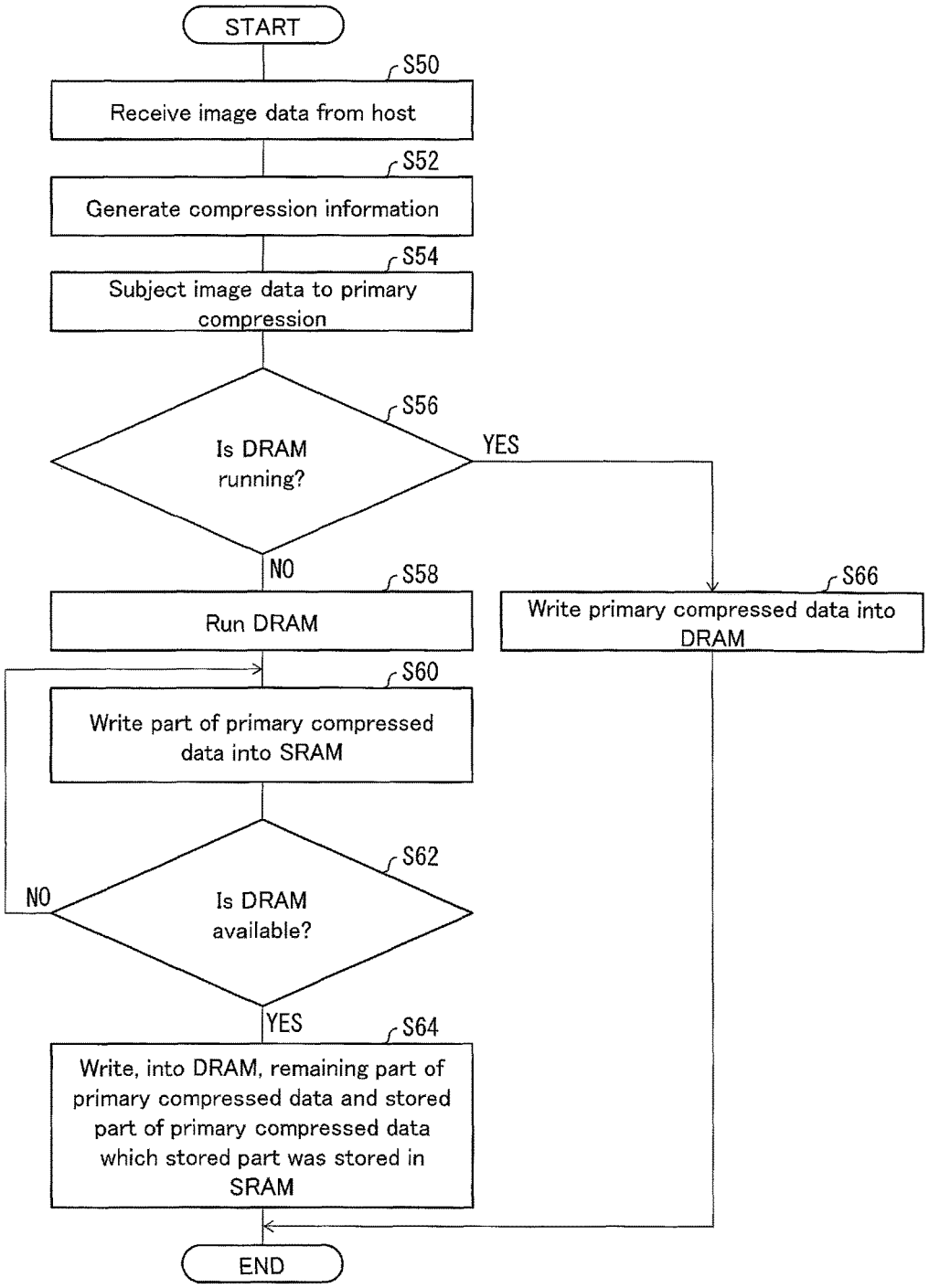
FIG. 6 illustrates (i) a flow of input/output of image data into/from the display controller according to Embodiment 2 of the present invention and (ii) how data is written into a DRAM and a SRAM.

A flow of a process carried out by the display controller 1 at an input start timing will be described next with reference to FIG. 6. FIG. 6 is a flow chart illustrating the flow of the process carried out by the display controller 1 at an input start timing. At an input start timing, the host 2 transmits image data to the display controller 1 in synchronization with a TE signal supplied from the display controller 1. The input section 10 of the display controller 1 receives the image data (S50), and the image data is then transmitted to the primary compression section 20 via the input section 10. Then, the primary compression section 20 (i) generates compression information based on the image data thus received (S52) and (ii) subjects the image data to primary compression (S54). In so doing, in a case where the DRAM 31 is running (YES in S56), the primary compression section 20 writes primary compressed data into the DRAM 31 (S66).

On the other hand, in a case where the DRAM 31 is not running (NO in S56), the timing controller 60 sequentially runs storage regions of the DRAM 31 (S58). Along with this, the primary compression section 20 sequentially writes parts of the primary compressed data (e.g. lines of data, one by one) into the SRAM 32 (S60). The primary compression section 20 writes the primary compressed data into the SRAM 32 until any one of the storage regions of the DRAM 31 runs (S62). Then, in a case where the any one of the storage regions of the DRAM 31 runs (has become available) (YES in S62), the primary compression section 20 (i) stops writing the primary compressed data into the SRAM 32 and (ii) sequentially writes remaining parts of the primary compressed data into running storage regions of the DRAM 31. In so doing, the primary compression section 20 also writes (copies), into the DRAM 31 (from the SRAM 32 to the DRAM 31), the parts of the primary compressed data which parts were written into the SRAM 32 in the step S60 (S64).

Embodiment 3

The LCD 3 according to an aspect of the present invention is preferably a display employing particularly an oxide semiconductor for a semiconductor layer of a TFT (Thin-Film Transistor). Specific examples of the oxide semiconductor encompass an oxide (In—Ga—Zn—O) containing indium, gallium, and zinc. In general, a display updates (refreshes) a display screen at predetermined intervals even in a case where there is no change in image data to be displayed on the display screen (i.e. the same image data is to continue being displayed). This causes a display controller to also supply image data to the display along with the intervals at which the displays refreshes the display screen.

Meanwhile, since the TFT of the oxide semiconductor has little power leakage, the TFT has such a characteristic as being able to maintain an electric potential for a certain period of time even during an OFF state. Therefore, if the LCD 3 is a display employing an oxide semiconductor for a semiconductor layer, it is possible that the LCD 3 refreshes a display screen (writes signals into pixels) less frequently than conventional displays do, during a period during which an image displayed by the LCD 3 is not changed. Specifically, in a case where the In—Ga—Zn—O oxide semiconductor is employed and where the same image data continues to be displayed by the LCD 3, the LCD 3 can refresh the display screen one time to several times per second. This allows the display controller 1 to accordingly transmit image data at longer intervals, and therefore allows the memory retaining operation of the DRAM 31 to be stopped for a longer period of time. This allows not only the LCD 3 but also the display controller 1 to consume merely a reduced amount of electric power.

[Variations]

In each of the above embodiments, the memories of the frame buffer 30 were not limited to a DRAM and a SRAM. Alternatively, a display controller 1 according to an aspect of the present invention is preferably configured so that a frame buffer 30 includes (i) a DRAM and (ii) a SRAM which is smaller in capacity than the DRAM. In general, a DRAM is high integration (low cost) memory. However, a DRAM requires a refreshing operation (memory retaining operation) for retaining information stored therein. In contrast, although a SRAM is a low integration (high cost) memory, a SRAM requires no refreshing operation. Therefore, a SRAM consumes electric power (particularly electric power for retaining information) less than a DRAM which is identical in capacity to the SRAM.

Therefore, since the display controller 1 according to the aspect of the present invention is configured so that the frame buffer 30 includes a high-capacity DRAM and a low-capacity SRAM, it is possible to (i) reduce electric power consumption and (ii) allows the frame buffer 30 to occupy merely a small area of the display controller 1 (i.e. to increase the degree of integration of the frame buffer 30). This allows a display controller 1 with low electric power consumption to be realized at a low cost. For example, in a case where the cost per storage capacity of the DRAM 31 is ⅕ of that of the SRAM 32, the display controller 1 is preferably designed so that the storage capacity of the SRAM 32 is ⅕ or less of that of the DRAM 31.

Alternatively, a display controller 1 according to an aspect of the present invention can be configured so that in a case where the storage capacity of the DRAM 31 is larger than a size of image data received by an input section 10, a primary compression section 20 does not subject the image data to primary compression. Specifically, the display controller 1 can be configured so that the primary compression section 20 (i) generates compression information corresponding to the image data and (ii) the writes the image data into the DRAM 31 without subjecting the image data to primary compression. Since primary compression is thus unnecessary, the display controller 1 can store received image data without delay.

Alternatively, a display controller 1 according to an aspect of the present invention can be configured so that a secondary compression section 70 predicts data size based on image data received from a host 2 and on compression information, the data size being a size in a case where the image data is compressed, and, in a case where the data size is equal to or less than a capacity of a SRAM 32, subjects the image data to secondary compression and then stores secondary compressed data in the SRAM 32. In so doing, in a case where the data size thus predicted is larger than the capacity of the SRAM 32, it is possible to (i) select, based on the compression information, a secondary compression method in which a compression ratio (%) is lower (i.e. data can be compressed so as to have a smaller data size) or (ii) discontinue subjecting the image data to secondary compression and discontinue storing secondary compressed data in the SRAM 32.

In a case where subjecting of the image data to secondary compression and storing of the secondary compressed data in the SRAM 32 are discontinued, a timing controller 60 can keep a DRAM 31 running, so that in a case where the image data is to be supplied to an LCD 3, primary compressed data is read out from the DRAM 31, decompressed, and then supplied to the LCD 3.

[Software Implementation Example]

Control blocks of the display controller 1 (particularly, primary compression section 20, decompression section 40, update judging section 61, and secondary compression section 70) can be realized by a logic circuit (hardware)

provided in an integrated circuit (IC chip) or the like or can be alternatively realized by software as executed by a CPU (Central Processing Unit).

In the latter case, the display controller 1 includes a CPU that executes instructions of a program that is software realizing the foregoing functions; ROM (Read Only Memory) or a storage device (each referred to as "storage medium") in which the program and various kinds of data are stored so as to be readable by a computer (or a CPU); and RAM (Random Access Memory) in which the program is loaded. An object of the present invention can be achieved by a computer (or a CPU) reading and executing the program stored in the storage medium. Examples of the storage medium encompass "a non-transitory tangible medium" such as a tape, a disk, a card, a semiconductor memory, and a programmable logic circuit. The program can be supplied to the computer via any transmission medium (such as a communication network or a broadcast wave) which allows the program to be transmitted. Note that the present invention can also be achieved in the form of a computer data signal in which the program is embodied via electronic transmission and which is embedded in a carrier wave.

[Summary]

A display controller (display controller 1) according to Aspect 1 of the present invention includes: a first memory (DRAM 31) in which image data received from a host (host 2) is to be stored; a second memory (SRAM 32) which consumes electric power less than the first memory; an update judging section (update judging section 61) for judging whether or not the image data received from the host is updated; a compression section (secondary compression section 70); and a decompression section (decompression section 40), the display controller supplying the image data to a display section (LCD 3) at a predetermined timing, and in a case where the update judging section has judged that the image data received from the host has not been updated, the compression section (i) subjecting the image data read out from the first memory to secondary compression (secondary compression), so that secondary compressed data is generated and then (ii) storing the secondary compressed data in the second memory, the first memory stopping an memory retaining operation, and the decompression section (i) decompressing the secondary compressed data (secondary compressed data) read out from the second memory, so that secondary decompressed data is generated and then (ii) supplying the secondary decompressed data to the display section.

According to the configuration, in a case where image data received from the host has not been updated, the display controller (i) subjects the image data in the first memory to secondary compression, so that the image data is converted to have a data size allowing the secondary compressed data to be stored in the second memory and then (ii) stores the secondary compressed data in the second memory. Then, the display controller controls the first memory to stop a memory retaining operation (refreshing operation). In addition, along with a timing at which the display section refreshes an image on the screen, the display controller reads out the secondary compressed data from the second memory, decompresses the secondary compressed data, and then outputs the decompressed data.

In a case where image data has not been updated, the display controller can thus retain image data in the second memory which consumes little electric power. This allows image data to be outputted while the first memory, which consumes larger electric power consumption than the other one, is stopped from carrying out a memory retaining operation. Therefore, the display controller can reduce electric power consumption.

In Aspect 2 of the present invention, a display controller according to Aspect 1 of the present invention can be configured to further include: a compression information generating section (primary compression section 20) for generating compression information based on the image data received from the host, which compression information concerns the image data and includes at least one of (i) statistical information about a data value, (ii) a predicted value of a compression ratio, and (iii) a predicted value of a level of degradation caused by compression, the compression section selecting, in accordance with the compression information, a compression algorithm or a compression parameter to be used for the secondary compression. According to the configuration, the display controller can select, in accordance with compression information, an optimum algorithm or an optimum parameter for compression of image data.

In Aspect 3 of the present invention, a display controller according to Aspect 2 of the present invention can be configured so that the compression information contains, as the statistical information, a histogram of data values. With the configuration, the display controller can subject image data to compression with the use of a histogram of data values. This makes it possible to subject image data to compression with the use of a more proper algorithm or more proper parameters.

In Aspect 4 of the present invention, a display controller according to Aspect 2 or 3 of the present invention is preferably configured so that: in addition to generating the compression information, the compression information generating section (i) subjects the image data received from the host to primary compression (primary compression), so that primary compressed data is generated and then (ii) stores the primary compressed data (primary compressed data) in the first memory; the decompression section (i) decompresses the primary compressed data read out from the first memory, so that primary decompressed data is generated and then (ii) supplies the primary decompressed data to the display section; and a compression ratio (%) during the secondary compression carried out by the compression section is lower than a compression ratio (%) during the primary compression carried out by the compression information generating section.

With the configuration, the display controller can cause the data size of image data to be smaller in a case where image data is stored in the second memory than in a case where image data is stored in the first memory.

In Aspect 5 of the present invention, a display controller according to any one of Aspects 2 through 4 can be configured so that the compression section predicts data size based on the image data received from the host and on the compression information, the data size being a size in a case where the image data is compressed, and, in a case where the data size is equal to or less than a capacity of the second memory, subjects the image data to compression, stores compressed data in the second memory, and stops a memory retaining operation of the first memory.

According to the configuration, in a case where the data size of compressed image data is larger than the storage capacity of the second memory, the display controller can (i) prevent an unnecessary process of compressing the image data from being carried out even though the compressed image data cannot be contained in the second memory and (ii) prevent image data, which is stored in the first memory, from being accidentally lost as a result of stopping the memory retaining operation of the first memory.

In Aspect 6 of the present invention, a display controller according to any one of Aspects 1 through 5 of the present invention can be configured so that in a case where image data received from the host during current transmission from the host is different from image data received from the host during immediately preceding transmission from the host, the update judging section judges that the image data is updated. In other words, in a case where the image data received from the host during current transmission from the host is identical to image data received from the host during immediately preceding transmission from the host, the display controller can judge that image data is updated. Since the display controller makes judgment in such a manner, the display controller can reduce electric power consumption as with Aspect 1 even in a case where the display controller continues to receive the same image data from the host, that is, even in a case where the display controller continues to supply the same image to the display section.

In Aspect 7 of the present invention, a display controller according to any one of Aspects 1 through 6 of the present invention can be configured to further include: a storage section (primary compression section 20) for storing the image data in the first memory or the second memory, in a case where the update judging section has judged that the image data from the host is updated while the memory retaining operation of the first memory is stopped, (i) the storage section storing part of the image data in the second memory and (ii) the first memory restarting the memory retaining operation, and in a case where the first memory has become available, the storage section storing, in the first memory, (i) a remaining part of the image data and (ii) the part of the image data, which part was stored in the second memory.

With the configuration, the display controller can keep the memory retaining operation of the first memory stopped until updating of the image data from the host is restarted. This prevents unnecessary running of a refreshing operation of the first memory from occurring. Therefore, it is possible to reduce electric power consumption of an entire display controller.

In Aspect 8 of the present invention, a display controller according to any one of Aspects 1 through 7 is preferably configured so that the first memory is a DRAM (dynamic random access memory), whereas the second memory is a SRAM (static random access memory). According to the configuration, it is possible not only to reduce electric power consumption of the display controller, but also to allow the first memory and the second memory to occupy merely a small area of the display controller (i.e. to increase the degree of integration). This allows a display controller with low electric power consumption to be realized at a low cost.

In Aspect 9 of the present invention, an electronic device preferably includes: a display controller according to any one of Aspects 1 through 8; a host; and a display section, the display section being a display employing an oxide semiconductor for a semiconductor layer of a TFT (Thin-Film Transistor). With the configuration, the electronic device can cause intervals, at which the display section refreshes a display screen, to be longer during a period during which an image displayed by the display section is not changed. This allows the display controller to accordingly transmit image data at longer intervals, and therefore allows the memory retaining operation of the firs memory to be stopped for a longer period of time. This allows not only the display controller but ultimately the entire electronic device to also consume a merely reduced amount of electric power.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention can be suitably applied to a display controller which supplied received image data to a display device along with a timing at which the display device displays an image.

REFERENCE SIGNS LIST

1 Display controller
2 Host
3 LCD (display section)
20 Primary compression section (compression information generating section)
31 DRAM (first memory)
32 SRAM (second memory)
40 Decompression section
61 Update judging section
70 Secondary compression section (compression section)

The invention claimed is:

1. A display controller comprising: a first memory in which image data received from a host is to be stored; a second memory that consumes electric power less than the first memory; an update judging section for judging whether or not the image data received from the host is updated; a storage section that stores the image data in the first memory or the second memory such that: in a case where the update judging section has judged that the image data from the host is updated while a memory retaining operation of the first memory is stopped, (i) the storage section stores a portion of the image data in the second memory before the first memory becomes available and (ii) the first memory restarts the memory retaining operation; and in a case where the first memory has become available, the storage section stores, in the first memory, (i) a remaining portion of the image data and (ii) the portion of the image data that was stored in the second memory, the remaining portion of the image data being data other than the portion of the image data stored in the second memory; a compression section; and a decompression section, wherein the display controller supplies the image data to a display section at a predetermined timing, and in a case where the update judging section has judged that the image data received from the host has not been updated, the compression section (i) subjects the image data read out from the first memory to secondary compression, so that secondary compressed data is generated and then (ii) stores the secondary compressed data in the second memory, the first memory stops the memory retaining operation, and the decompression section (i) decompresses the secondary compressed data read out from the second memory, so that secondary decompressed data is generated and then (ii) supplies the secondary decompressed data to the display section.

2. A display controller as set forth in claim 1, further comprising:

a compression information generating section that generates compression information based on the image data received from the host, which compression information concerns the image data and includes at least one of (i) statistical information about a data value, (ii) a predicted value of a compression ratio, and (iii) a predicted value of a level of degradation caused by compression, wherein the compression section selects, in accordance with the compression information, a compression algorithm or a compression parameter to be used for the secondary compression.

3. The display controller as set forth in claim 2, wherein:

in addition to generating the compression information, the compression information generating section (i) subjects the image data received from the host to primary compression, so that primary compressed data is generated and then (ii) stores the primary compressed data in the first memory;

the decompression section (i) decompresses the primary compressed data read out from the first memory, so that primary decompressed data is generated and then (ii) supplies the primary decompressed data to the display section; and a compression ratio (%) during the secondary compression carried out by the compression section is lower than a compression ratio (%) during the primary compression carried out by the compression information generating section.

4. The display controller as set forth in claim 1, wherein in a case where image data received from the host during current transmission from the host is different from image data received from the host during immediately preceding transmission from the host, the update judging section judges that the image data is updated.

5. The display controller as set forth in claim 1, wherein the first memory is a DRAM (dynamic random access memory), and the second memory is a SRAM (static random access memory).

* * * * *